US007311043B2

(12) United States Patent
Mayer et al.

(10) Patent No.: US 7,311,043 B2
(45) Date of Patent: Dec. 25, 2007

(54) DATA CARRIER WITH A PRINTED SECURITY ELEMENT AND GRAVURE PRODUCTION METHOD THEREOF

(75) Inventors: Karlheinz Mayer, Augsburg (DE); Roger Adamczyk, München (DE); Peter Franz, Bruck (DE); Eckhard Braun, München (DE)

(73) Assignee: Giesecke & Devrient GmbH, Munich (DE)

( * ) Notice: Subject to any disclaimer, the term of this patent is extended or adjusted under 35 U.S.C. 154(b) by 77 days.

(21) Appl. No.: 10/168,534

(22) PCT Filed: Dec. 28, 2000

(86) PCT No.: PCT/EP00/13309

§ 371 (c)(1),
(2), (4) Date: Oct. 17, 2002

(87) PCT Pub. No.: WO01/49505

PCT Pub. Date: Jul. 12, 2001

(65) Prior Publication Data

US 2003/0145747 A1 Aug. 7, 2003

(30) Foreign Application Priority Data

Dec. 30, 1999 (DE) ..... 199 63 849

(51) Int. Cl.
*B41F 9/00* (2006.01)

(52) U.S. Cl. ..... 101/150; 101/153; 283/72; 283/57

(58) Field of Classification Search ..... 101/150, 101/153, 170, 152, 151; 283/72, 94, 95, 283/98, 91, 92, 57, 58, 59
See application file for complete search history.

(56) References Cited

U.S. PATENT DOCUMENTS

| | | | | |
|---|---|---|---|---|
| 3,599,153 | A * | 8/1971 | Lewis et al. | 235/449 |
| 4,033,059 | A * | 7/1977 | Hutton et al. | 283/91 |
| 4,112,189 | A * | 9/1978 | Terwilliger | 428/443 |
| 4,588,212 | A * | 5/1986 | Castagnoli | 283/91 |
| 4,597,593 | A * | 7/1986 | Maurer | 283/94 |
| 5,199,744 | A * | 4/1993 | Shenton | 283/91 |
| 5,433,807 | A * | 7/1995 | Heckenkamp et al. | 156/230 |
| 5,487,567 | A * | 1/1996 | Volpe | 283/72 |
| 5,582,103 | A * | 12/1996 | Tanaka et al. | 101/32 |

(Continued)

FOREIGN PATENT DOCUMENTS

DE 19845436 A1 * 4/2000

(Continued)

OTHER PUBLICATIONS

Dictionary.com printout, definition of "intaglio printing", 1 page, May 15, 2007.*

*Primary Examiner*—Ren Yan
*Assistant Examiner*—Kevin D. Williams
(74) *Attorney, Agent, or Firm*—Bacon & Thomas, PLLC

(57) ABSTRACT

The invention relates to a data carrier with a security printed image produced by intaglio printing. The security printed image consists of a plurality of contrasting structural elements disposed in exact register. A first part of the structural elements is designed to be relieflike and tactile and a second part of the structural elements flat and nontactile.

28 Claims, 4 Drawing Sheets

U.S. PATENT DOCUMENTS 5,722,693 A * 3/1998 Wicker ..... 283/67
5,735,547 A * 4/1998 Morelle et al. ..... 283/67
5,797,632 A * 8/1998 Rice ..... 283/114
5,801,857 A * 9/1998 Heckenkamp et al. ..... 359/2
5,915,731 A * 6/1999 Jackson ..... 283/91
5,972,545 A * 10/1999 Eid et al. ..... 430/7
6,036,233 A * 3/2000 Braun et al. ..... 283/91
6,098,546 A * 8/2000 Schell ..... 101/492
6,142,618 A * 11/2000 Smith et al. ..... 347/85
6,176,522 B1 * 1/2001 Jackson ..... 283/91
6,183,671 B1 * 2/2001 Stauffacher et al. ..... 264/40.1
6,227,572 B1 * 5/2001 Lyen ..... 283/58
6,347,480 B1 * 2/2002 Weder ..... 47/72
6,928,925 B1 * 8/2005 Mayer et al. ..... 101/150
7,028,615 B2 * 4/2006 Mayer et al. ..... 101/150

FOREIGN PATENT DOCUMENTS

JP 3-53970 3/1991
JP 03053970 3/1991
WO 98/33658 8/1998

* cited by examiner

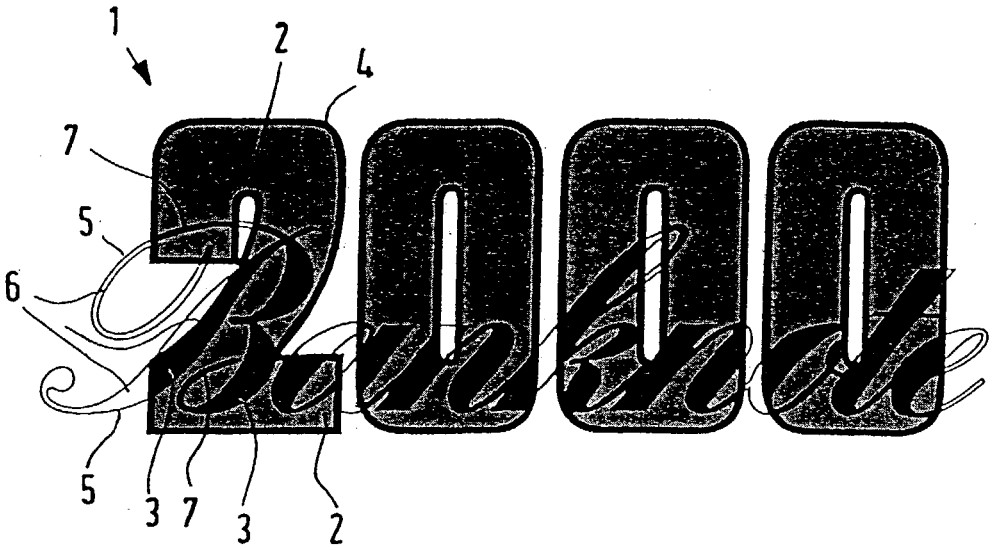
FIG.1
FIG.2
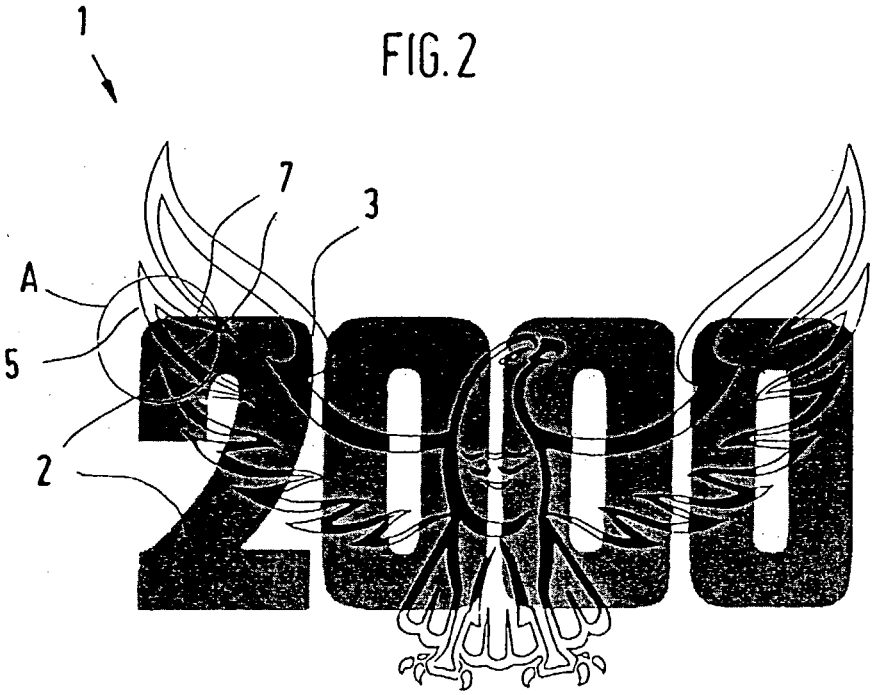

DATA CARRIER WITH A PRINTED SECURITY ELEMENT AND GRAVURE PRODUCTION METHOD THEREOF

BACKGROUND

This invention relates to a data carrier with a security printed image and to a printing plate for producing such a printed image.

For producing high-quality printed products such as bank notes, shares or the like one frequently uses intaglio printing for forgery protection since the printing plate production is very elaborate and expensive and this method produces a very characteristic printed image which cannot be imitated using other printing methods.

In intaglio printing, areal representations are produced by closely adjacent engraved lines, the individual engraved lines normally being fractions of a millimeter wide and being separated by unengraved lands.

For the printing operation the engraved lines of the printing plate are filled with ink. Excess ink is removed from the printing plate with the aid of a wiping cylinder or doctor blade such that only the engraved lines are filled with ink. This wiping process thus removes all ink components on the printing plate surface.

In the printing operation the data carrier to be printed, normally paper, is finally pressed onto the printing plate at high pressure by means of a pressure cylinder with an elastic surface. The data carrier is thereby pressed into the ink-filled engraved lines of the printing plate, thus coming in contact with the ink. When the data carrier is detached it pulls the ink out of the depressions of the engraved lines. The thus produced printed image has printed lines which vary in ink layer thickness depending on the depth of the engraving.

If one uses transparent inks in intaglio printing one obtains a light tint when printing a white data carrier with small ink layer thicknesses, and darker tones when printing with thick ink layers. In comparison with other common printing methods, intaglio printing can produce printed images with very great ink layer thicknesses. The resulting printed images are even manually tactile if accordingly deep engravings are used. The use of accordingly fine engravings also permits extremely fine, very sharp printed lines.

WO 97/48555 describes a method for producing intaglio printing plates in reproducible, machine-made fashion and permitting line width and line depth to be adjusted largely independently of each other. For this purpose the lines of a line original are detected and the surface area of each line exactly determined. With an engraving tool, for example a rotating chisel or a laser beam, the outside contour of said surface area is first engraved in order to cleanly outline the surface area. The outlined area of the surface area is subsequently cleared out using the same or another engraving tool so that the total line is exactly engraved in accordance with the line original. In this way one can also produce very narrow lines with a relatively great engraving depth, i.e. high inking on the data carrier. This makes even very fine lines tactile as reliefs.

SUMMARY

The invention is based on the problem of proposing a data carrier with a printed image produced by intaglio printing and having very high forgery-proofness.

The invention is based on composing the printed image provided on the data carrier of a plurality of contrasting structural elements, said structural elements being disposed in exact register, and designing at least one part of said structural elements to be relieflike and tactile, and one part of the structural elements flat and nontactile. Said structural elements are preferably produced on the data carrier in a printing operation by intaglio printing.

"Register" designates within the meaning of the invention the exact bordering or adjoining of the large-area and filigree or the relieflike and flat structural elements in the transition area where large-area and filigree or relieflike and flat structures abut.

"Relieflike" designates a raising of the structural elements over the data carrier surface as a reference plane by more than about 30 microns, preferably about 40 microns to about 100 microns. In contrast, "flat" designates in the ideal case a structural element lying in the data carrier surface as a reference plane, but which may be raised by at most about 25 microns to 30 microns over the reference plane, preferably no more than 25 microns.

It is to be heeded that a relief on the data carrier surface does not identically match the engraving depth of the printing plate. This is because the data carrier is not pressed in down to the base of the printing plate engraving during the printing operation and ink present in the depressions of the printing plate is not transferred completely to the data carrier. Accordingly, the engraving depth of the printing plate for relieflike structural elements is in the range of about 40 microns to 200 microns, preferably in the range of about 55 microns to 150 microns, and for flat structural elements in the range of about 5 microns to 50 microns, preferably in the range of about 10 microns to 25 microns. Whether an engraving depth in the borderline area leads to a relieflike or to a flat print on the surface of a data carrier also depends in the individual case on the slope steepness of the engraving, the nature of the substrate being printed (strength, plastic deformability) and the solid or solvent content of the printed ink.

When transparent inks are used the brightness impression of the tone depends on the printed layer thickness and the type, composition and concentration of the pigment. Layer thicknesses between about 2 microns and 5 microns produce a lighter, more transparent tone, and prints with such layer thicknesses are nontactile. In the layer thickness range between about 5 microns and 10 microns the tone is darker but the printed image still nontactile. Only at layer thicknesses of about 10 microns to 30 microns does the now clearly darker printed image become tactile. A visually recognizable contrast between the inventive structural elements can thus be produced via ink layer thickness. Since tactility is a subjective sensation, a value as of which a relief is sensed tactilely can only be determined within rough limits. The tactility of a printed image relief depends not only on the absolute relief height and individual sensitivity but also on the superficial extent of the printed structure and on whether the printed structure to be felt stands alone or is integrated into printed surroundings.

One can finally further increase the forgery-proofness of the inventive security element or security printed image by causing frequent alternation between the different structural elements. The structural elements differ with respect to their superficial extent and/or their light-dark contrast and/or their tactility. The exact register between the different structural elements and the resulting special optical impression of the security printed image can be produced only by intaglio printing, i.e. using a printing plate in which the security printed image is engraved completely and with the necessary register.

The structural elements can additionally be combined with negative elements. "Negative element" designates an area of any shape not covered with ink in surroundings covered with ink. Such negative elements can be present within a structural element as unprinted pictorial or alphanumeric information, such as a logo, the denomination of a currency, or writing, so that a structural element is not covered completely with ink. Alternatively, the negative elements can also be formed as separating lines between the individual structural elements. In this case the negative elements preferably have the form of complicated line patterns, such as guilloches.

Since very sharp contours can be printed by intaglio printing, it is possible to produce visually recognizable negative characters with very small line widths of up to 10 microns. Such additional information can be taken into account in a very simple way in the inventive engraving method for producing the printing plate. For a potential forger, however, it constitutes an additional problem.

According to a preferred embodiment, one part of the inventive structural elements is designed to be large-area and one part of the structural elements filigree.

"Large-area" means that the structural elements are not produced by halftone printing but actually consist of areal elements with a certain width greater than about 1 millimeter.

"Filigree", in contrast, means that thin lines are involved which optionally intersect and are intertwined, such as guilloches. The line width of said filigree structures is less than 1 millimeter and preferably less than 0.5 millimeters.

According to a further preferred embodiment, the structural elements are selected and disposed in register so as to create at least two visually recognizable, preferably superimposed pieces of information. For example, a first piece of information can be composed of relieflike and tactile structural elements, while a second piece of information consists at least for the most part of flat, nontactile structural elements.

If one part of the structural elements is additionally designed to be filigree and a further part large-area, the information can be composed for example as follows. All filigree structural elements and one part of the large-area structural elements of the inventive security element are designed to be relieflike and tactile and form a first visually recognizable piece of information. One part of said tactile structural elements simultaneously belongs to a second piece of information having not only the tactile but also flat, nontactile structural elements. The flat structural elements of the second piece of information preferably occupy a greater surface area so that the visual impression of the second piece of information is determined primarily by the flat structural elements. The tactile structural elements form only a kind of superimposed, preferably darker, pattern with respect to the second piece of information. The remaining part of the structural elements of the first piece of information, said part preferably consisting only of filigree structural elements, adjoins the second piece of information in register. According to a special embodiment, said filigree structural elements continue the contour lines of the relieflike structural elements common to both pieces of information.

This security element can have negative elements according to a further preferred embodiment. For example, the structural elements of the first and second pieces of information can be separated by a narrow, unprinted contour line. In this case the structural elements belonging only to the first piece of information can also continue said unprinted contour line.

The printing plate for producing this printed image bears the corresponding structural elements in the form of depressions, said structural elements being disposed in exact register here too. The engraving depth of the individual structural elements is selected such that a first part of said structural elements is relieflike and tactile after the printing operation and the second part of the structural elements has a smaller engraving depth so that the structural elements are flat and nontactile after the printing operation. Preferably, the engraving depth of the first part of the structural elements is about 40 microns to 200 microns, preferably about 55 microns to 150 microns, and that of the second part about 5 microns to 50 microns, preferably about 15 microns to 40 microns.

Since the relief height achieved in the printed product depends not only on the engraving depth of the printing plate but also on the properties of the substrate and the ink, as mentioned above, an engraving depth of 40 microns can in extreme cases already lead to a relieflike printed image while an engraving depth of 50 microns can still lead to a flat image under other material and printing parameters. However, in every specific case of application the engravings leading to relieflike printed image areas are always deeper than those producing so-called flat, nontactile image areas.

In a further preferred embodiment of the invention, the structural elements are designed such that the area where the two pieces of information overlap either remains unprinted or is rendered in a tone clearly differing visually both from the relieflike and tactile and the flat and nontactile structural elements. The relieflike and the flat structural elements and the unprinted or contrasting-tone overlap area are again in exact register.

Further embodiments and advantages of the invention will be explained in the following with reference to the figures. It is pointed out in this context that the figures are schematic diagrams which in particular do not render either line widths or layer thickness relations true to scale.

BRIEF DESCRIPTION OF THE DRAWINGS

FIG. 1 shows a first embodiment of the inventive security element,

FIG. 2 shows a second embodiment of the inventive security element,

DETAILED DESCRIPTION OF VARIOUS EMBODIMENTS

Figure 3:
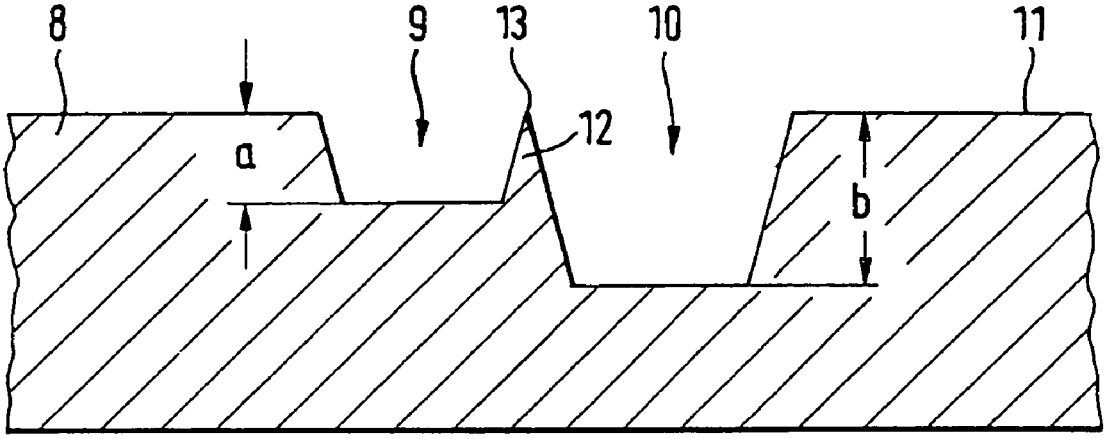
FIG. 3 shows a detail of an inventive printing plate.

FIG. 1 shows a first embodiment of inventive security element 1. Security element 1 is composed of a plurality of structural elements disposed in exact register. One part of said structural elements, shown black in the figure, is designed to be relieflike and tactile, the other part of the structural elements, shown gray in the figure, flat and nontactile. All said structural elements are produced on any substrate in a printing operation by intaglio printing. In the example shown, the individual structural elements are disposed relative to each other so as to create two visually recognizable pieces of information, i.e. the number "2000" superimposed by the writing "Bank note".

For reasons of clarity, the principle of the invention will be explained only with reference to the structural elements belonging to the number "2" and the letter "B". The other information components are composed analogously.

The number "2" is composed of large-area, flat and nontactile structural elements 2, likewise large-area but relieflike and tactile structural elements 3 and filigree and relieflike, tactile structural elements 4, 7. Structural elements 4 form the contour line of the number "2". All structural elements and in particular structural elements 4, 7 and 3, 4 are disposed in register within the meaning of the invention.

Further, the different structural elements, e.g. structural elements 2, 4 or 2, 3, directly adjoin each other.

Structural elements 3, 7 are simultaneously part of a second piece of information which together with filigree, relieflike and tactile structural elements 5 forms the letter "B". Structural elements 5 are formed in this case as filigree lines disposed in register with structural elements 3 and 7. They enclose unprinted areas 6.

FIG. 2 shows another embodiment of inventive security element 1. One again sees two pieces of information in overlap. In this case the first piece of information, the number "2000", is likewise composed of flat, nontactile structural elements 2, filigree, relieflike and tactile structural elements 7 and large-area, tactile structural elements 3. As in FIG. 1, the flat, nontactile structural elements are gray and the relieflike, tactile structural elements black.

In comparison with FIG. 1, this case lacks filigree, relieflike contour line 4. Therefore all relieflike and tactile structural elements are simultaneously part of the second piece of information here. Outside the overlap area, relieflike, tactile structural elements 3 and 7 are supplemented by further relieflike, filigree structural elements 5. Only a total view of structural elements 3, 5, 7 makes the second piece of information, an eagle here, visually recognizable.

Both security element 1 shown in FIG. 1 and that shown in FIG. 2 are produced in a printing operation. One preferably uses a transparent ink so that flat structural elements 2 appear in a lighter tone while relieflike structural elements 3, 4, 5, 7 are rendered in a dark tone. The tone differences arise through different ink layer thicknesses. Accordingly, the printing form used for the printing operation has engravings varying in depth.

FIG. 3 shows the detail of an inventive printing plate in cross section. Printing plate 8 has deep engraved areas 9, 10 relative to printing plate surface 11. First engraved area 9 is engraved with engraving depth a, second engraved area 10 with engraving depth b. Engraved areas 9, 10 directly adjoin each other at the level of printing plate surface 11 and are separated by separating edge 12 whose upper edge 13 tapers at the level of printing plate surface 11. Printing plate 8 can also be designed so that upper edge 13 is slightly, i.e. a few microns, below the level of printing plate surface 11. Said separating edge ensures that adjoining ink areas have sharp contours. The production and design variants of such printing plates with separating edges are explained in detail in German patent application P 198 45 436.8, to which explicit reference is made.

Engraved area 9 produces a lighter tone than deeper engraved area 10 in the printing operation. If nontactile structural elements are produced with engraved area 9, engraving depth a is between 10 microns and 40 microns. For light tones which seem transparent, engraving depths of 10 microns to 25 microns are preferably used. The relieflike, tactile structural elements can be produced for example with engraved area 10. Engraving depth b is in this case between 40 microns and 200 microns.

Figure 4:
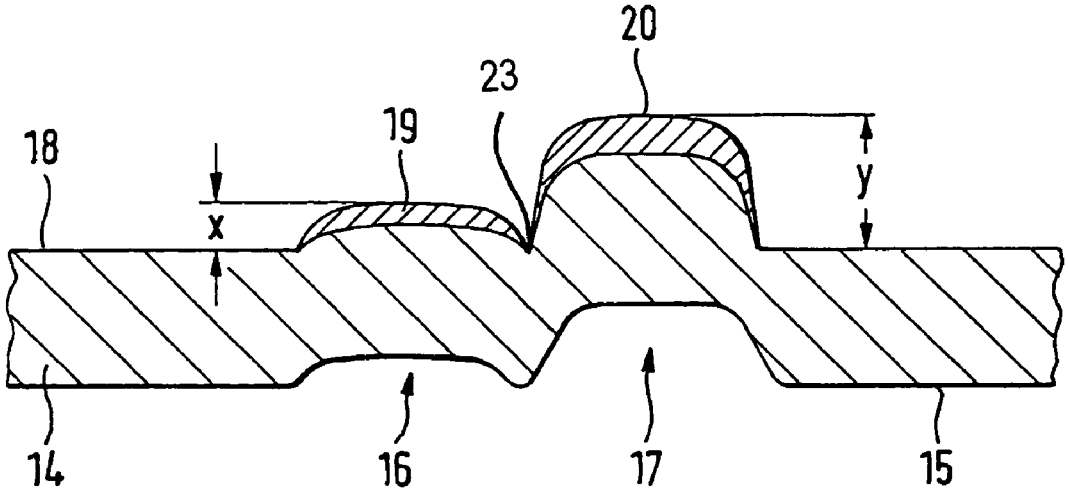
FIG. 4 shows a detail of a data carrier in cross section after printing with the printing plate according to FIG. 3.

FIG. 4 shows schematically the detail of substrate 14, such as paper, printed by intaglio printing with printing plate 8 according to FIG. 3. During the printing operation substrate 14 is pressed into engraved areas 9, 10, whereby corresponding depressions 16, 17 may remain on substrate underside 15 depending on how much pressure is exerted on the substrate during printing. Substrate top 18 has corresponding elevations in the areas where depressions 16, 17 are located on the underside. Said elevations are covered by ink layers 19, 20 received by substrate surface 18 from engraved areas 9, 10 during printing. The height of printed image relief x, y is fixed as the difference in level between the unprinted substrate surface and the surfaces of particular ink areas 19, 20. In the transition area between ink areas 19, 20 ink layer thicknesses x, y decrease continuously down to a borderline 23 defined by upper edge 13 of separating edge 12 of printing plate 8. Depending on the design of separating edge 12 the borderline area is more or less wide, which ensures a clean separation between the printed areas of different tone.

Figure 5A:
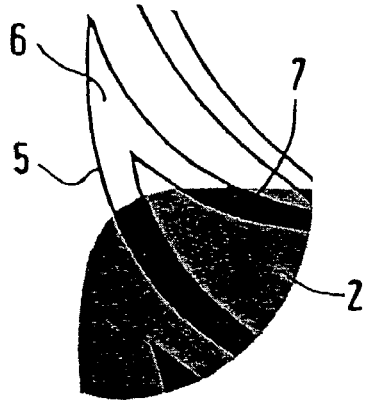
FIG. 5*a* shows enlarged detail A of the security element according to FIG. 2, FIGS. 5*b* and 5*c* show enlarged detail A according to FIG. 5*a* after an attempt at forgery.

FIG. 5*a* shows enlarged detail A of FIG. 2 which clearly shows that the individual structural elements are disposed in exact register. Thus, structural elements 7 are flush with structural elements 2. Structural elements 5 are disposed in register therewith. They adjoin structural elements 2 in register and run quasi seamlessly into the contour line of structural elements 7.

This exact alignment cannot be produced with conventional printing plates and printing methods. Using conventional printing plates one would have to perform at least two printing operations, e.g. printing structural elements 2 or the first piece of information, such as the number "2000", in the first printing operation and the second piece of information, for example the eagle shown in FIG. 2, over the first piece of information in the second printing operation. Such attempts at forgery are easy to recognize since conventional printing methods cannot achieve the desired register.

Figure 5B:
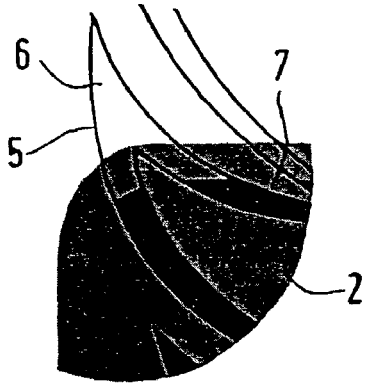
Figure 5C:
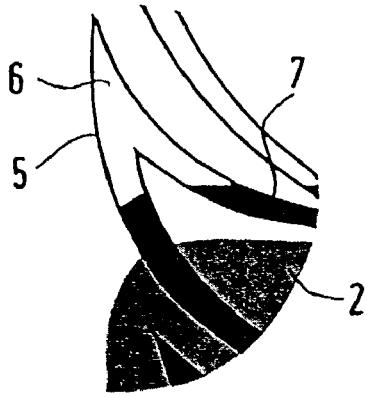

FIGS. 5*b* and 5*c* show the critical borderline areas after such an attempt at forgery. In FIG. 5*b*, for example, structural elements 2 protrude beyond structural elements 7 so that one part of areas 6 outlined by structural elements 5 is also filled with ink. In the embodiment shown in FIG. 5*c*, structural elements 7 end outside structural elements 2. Since such offsets greatly impair the general impression of the printed image, attempts to forge the inventive security element are very conspicuous.

Figure 6:
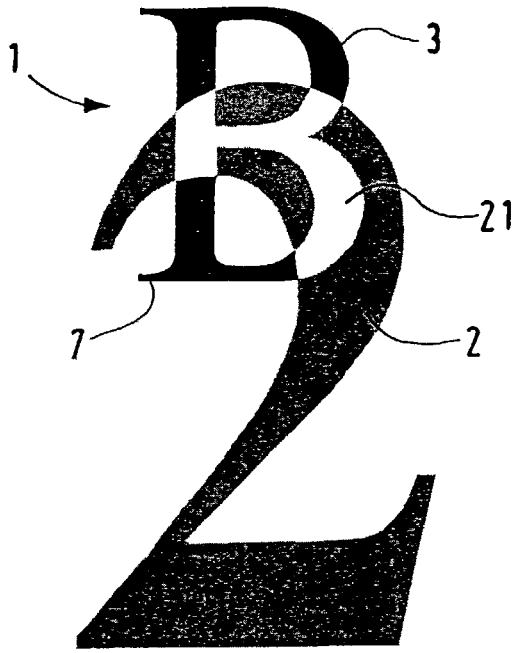
FIGS. 6 and 7 show two further embodiments of an inventive security element.
Figure 7:
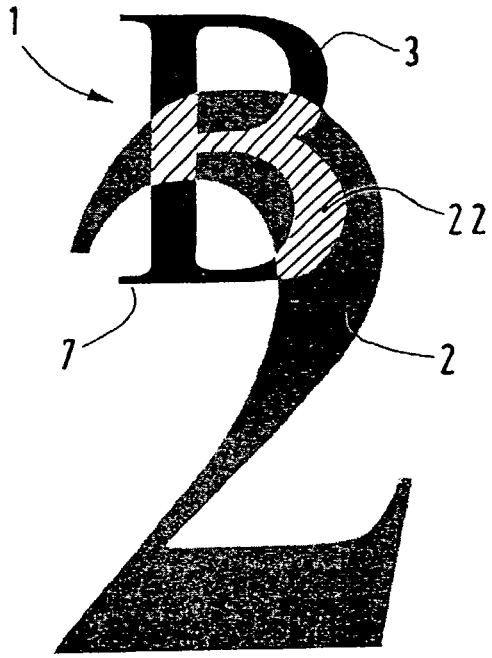

A further embodiment of inventive security element 1 is shown in FIGS. 6 and 7. The letter "B" is rendered as the first piece of information, having relieflike, tactile structural elements 3, 7 in the areas shown in black. The second piece of information is the number "2" in the present example, which is rendered substantially by large-area and flat, nontactile structural elements 2 shown in gray. Area 21 where the two pieces of information overlap is unprinted according to the embodiment of FIG. 6 but surrounded by printed areas and therefore easily recognized visually in its extension. In particular the corners of relieflike structural elements 3 and of flat structural elements 2 abut in exact register, which is not attainable in this way with conventional methods.

In the example according to FIG. 7, area 22 where the two characters "B" and "2" overlap is printed. In contrast to the variants of FIGS. 1 and 2, however, overlap area 22 is rendered here such that its contrast or tone clearly differs visually from that of directly adjacent relieflike structural elements 3 and that of flat structural elements 2. In FIG. 7 overlap area 22 is lighter than relieflike areas 3, 7 and flat areas 2 of the printed image. That is, the ink layer is thinnest in area 22 and area 22 is therefore flat and nontactile. However, it is also possible to design the ink layer thickness in overlap area 22 via a corresponding engraving of the printing plate so that it appears darker than adjacent flat structural elements 2 rendering the number "2", and lighter than tactile structural elements 3, 7 rendering the letter "B". The register between the individual structural elements can be excellently checked in particular at the corners and edges where they adjoin each other.

The inventive security element can be printed on any substrates. Preferably, these are data carriers made of paper. But one can also apply the inventive security element to foil substrates. The security element can be provided wherever high demands are made on protection from forgery, for example in papers of value, bank notes, ID cards, passports, or in official documents or high-quality admission tickets.

The invention claimed is:

1. A data carrier with a security printed image produced by intaglio printing and comprising of a plurality of contrasting structural elements disposed in exact register, wherein a first part of the structural elements is arranged to be relieflike and tactile and is raised by more than about 30 microns over the reference plane of the data carrier, and a second part of the structural elements is generally flat and nontactile and is raised by at most about 30 microns over the reference place of the data carrier;

wherein the first and second parts of the structural elements have a corresponding ink layer located on a surface of the data carrier.

2. A data carrier according to claim 1, wherein the relieflike and tactile structural elements have a darker tone than the flat, nontactile structural elements.

3. A data carrier according to claim 1, wherein one part of the structural elements is designed to be large-area and one part of the structural elements filigree.

4. A data carrier according to claim 3, wherein one part of the filigree structural elements is designed to be relieflike and tactile.

5. A data carrier according to claim 3, wherein one part of the large-area structural elements is designed to be relieflike and tactile.

6. A data carrier according to claim 1, wherein the security printed image has a plurality of mutually contrasting pieces of information differing by light-dark contrasts and/or large-area and filigree structural elements and having a tactile relief at least in partial areas.

7. A data carrier according to claim 1, wherein the security printed image has at least two visually recognizable overlapping pieces of information.

8. A data carrier according to claim 7, wherein the pieces of information overlap at an overlapping area having a tone differing visually from that of the relieflike and the flat structural elements outside the overlap area is provided.

9. A data carrier according to claim 7, wherein an area where pieces of information overlap is not printed by intaglio printing.

10. A data carrier according to claim 1, wherein the security printed image includes a first piece of information consisting at least partly of relieflike, tactile structural elements.

11. A data carrier according to claim 1, wherein the security printed image includes a second piece of information generally comprising flat, nontactile structural elements.

12. A data carrier according to claim 11, wherein the flat structural elements are limited by filigree, tactile structural elements.

13. A data carrier according to claim 1, wherein one part of the relieflike structural elements of the first piece of information is simultaneously part of the second piece of information.

14. A data carrier according to claim 1, wherein filigree structural elements of the first piece of information which are not part of the second piece of information are disposed in register with the structural elements of the second piece of information.

15. A data carrier according to claim 1, wherein the structural elements are separated by a narrow, unprinted contour line.

16. A data carrier according to claim 1, wherein the structural elements have negative elements in the form of alphanumeric characters and/or patterns.

17. A data carrier according to claim 1, wherein one part of the structural elements is arranged to be filigree and wherein the filigree structural elements are lines with a line with smaller than 1 millimeter, preferably smaller than 0.5 millimeters.

18. A data carrier according to claim 1, wherein one part of the structural elements is arranged to be large area, and wherein the large-area structural elements have a line width greater than 1 millimeter.

19. A data carrier according to claim 1, wherein the first and second parts comprise pieces of information that are alphanumeric information and/or pictorial information.

20. A data carrier according to claim 1, wherein the data carrier is a paper of value, preferably a bank note.

21. A data carrier according to claim 1, wherein the first part of the structural elements is raised by more than about 40 microns over the reference plane of the data carrier.

22. A data carrier according to claim 1, wherein the second part of the structural elements is raised by at most about 25 microns over the reference plane of the data carrier.

23. A method for producing a data carrier with a security ink printed image produced by intaglio printing and including a plurality of contrasting inked structural elements, comprising disposing said structural elements in exact register and arranging one part of said structural elements to be relieflike and tactile and is raised by more than about 30 microns over the reference plane of the data carrier, and one part of the structural elements to be flat and nontactile and is raised by at most 30 microns over the reference plane of the data carrier.

24. A method according to claim 23, wherein the relieflike and tactile part of the structural elements is raised by more than about 40 microns over the reference plane of the data carrier.

25. A method according to claim 23, wherein the flat and nontactile part of the structural elements is raised by at most about 25 microns over the reference plane of the data carrier.

26. A method for producing a security element comprising a security ink printed image produced by intaglio printing and including a plurality of contrasting inked structural elements, comprising disposing said structural elements in exact register and arranging one part of said structural elements to be relieflike and tactile and is raised by more than about 30 microns over the reference plane of the data carrier, and one part of the structural elements to be flat and nontactile and is raised by at most about 30 microns over the reference plane of the data carrier.

27. A method according to claim 26, wherein the relieflike and tactile part of the structural elements is raised by more than about 40 microns over the reference plane of the data carrier.

28. A method according to claim 26, wherein the flat and nontactile part of the structural elements is raised by at most about 25 microns over the reference plane of the data carrier.

* * * * *